US005329438A

United States Patent [19]

Thompson

[11] Patent Number: 5,329,438

[45] Date of Patent: Jul. 12, 1994

[54] OUTDOOR LIGHT REFLECTOR AND METHOD

[76] Inventor: Charles O. Thompson, 2500-C Devine St., Columbia, S.C. 29205

[21] Appl. No.: 51,183

[22] Filed: Apr. 22, 1993

[51] Int. Cl.[5] ..... F21S 1/10

[52] U.S. Cl. ..... 362/431; 362/296; 362/350; 362/437

[58] Field of Search ..... 362/296, 346, 347, 350, 362/431, 297, 410, 414, 416, 435, 436, 437, 438, 439, 453, 454

[56] References Cited

U.S. PATENT DOCUMENTS

| | | | |
|---|---|---|---|
| 2,274,405 | 2/1942 | Flaherty | 362/346 |
| 2,418,131 | 4/1947 | Margolis | 362/346 |
| 3,040,994 | 6/1962 | Anderson et al. | 362/346 |
| 4,285,034 | 8/1981 | Sullivan | 362/346 |
| 4,628,423 | 12/1986 | Ogle | 362/296 |

*Primary Examiner*—Ira S. Lazarus
*Assistant Examiner*—Alan B. Cariaso
*Attorney, Agent, or Firm*—Ralph Bailey

[57] ABSTRACT

A reflector for roadway use integrally spun from aluminum has a side reflector portion (A) of generally parabolic configuration, an inwardly directed flange (B) at the top for receiving a light source and a head fixture carrying same, and a lower end (C) entirely open to the atmosphere having about a 90° cutoff avoiding directing light at an angle above the horizontal. The reflector is secured to the head by a fastener (D).

7 Claims, 4 Drawing Sheets

Fig. 4.
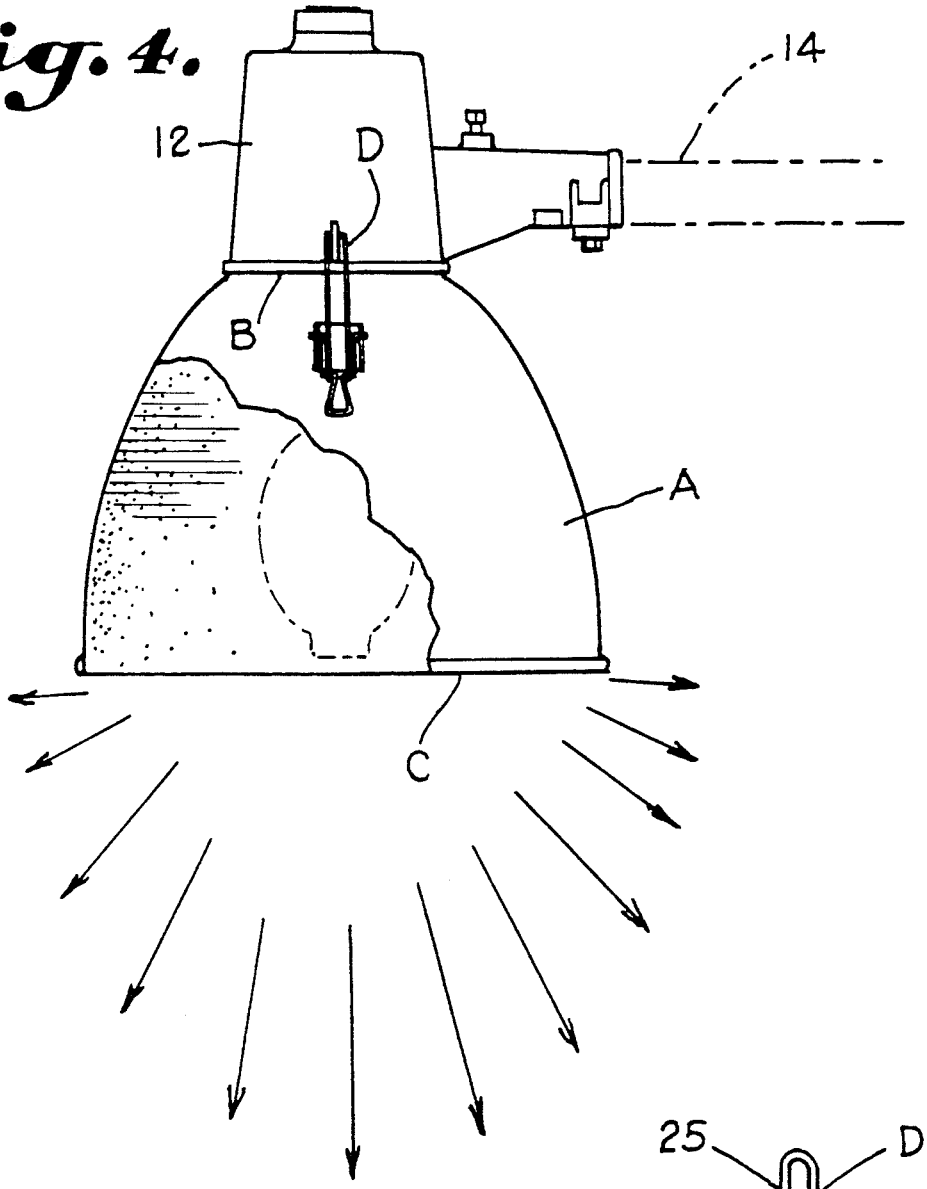
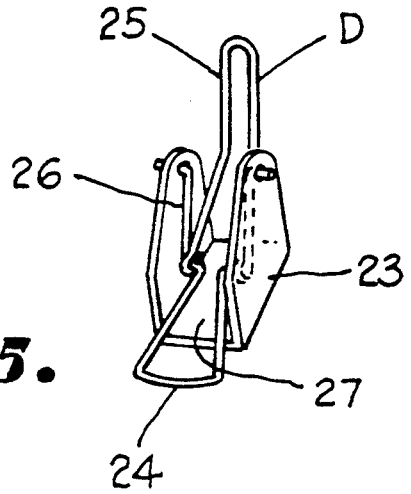
Fig. 5.

OUTDOOR LIGHT REFLECTOR AND METHOD

BACKGROUND OF THE INVENTION

This invention relates to a light impermeable reflector for roadway use with a head fixture housing bearing a depending light source improving spread and uniformity and reducing glare avoiding light pollution of the night sky.

The familiar NEMA Head luminaire with its standard refractor is a relatively inexpensive commodity widely accepted and used. The suppliers also make cut-off luminaries which attempt to achieve an aesthetic appearance for use such as in parking lots. Thus, if an end-user requires cut-off performance, a product, albeit expensive, has been available. Cutoff luminaries generally originated and were further developed utilizing the metal halide lamp which in most wattages, requires total enclosure calling for a tempered glass lens on their apertures.

Since several parts including a refractor must be carried by the head fixture assembly, several steps are required in the assembly operation.

Highbay reflectors are provided for interior use in high ceilinged bays of industrial plants. The luminaire assembly of which it is an integral part is not suitable for outdoor use.

Outdoor reflectors are further exemplified by U.S. Pat. Nos. 4,559,587 and 4,694,382.

The problem of light pollution of the night sky has attracted the attention of environmental organizations. Glare is another problem common to outdoor roadway lighting luminaire.

SUMMARY OF THE INVENTION

Accordingly, it is an important object of this invention to eliminate light emission above the horizontal base line of the reflector and hence avoid sky glow, a common form of light pollution.

Another object of this invention is to provide a reflector which extends below the lamp so that high angle luminance, seen as glare by approaching motorists, is improved visibility of the illuminated roadway.

Another important object of the invention is to provide a reflector for roadway use of such size, contour and reflective aluminum material as to elevate part of the lamp's output rather than direct all light straight down so as to produce a relatively broad distribution of light despite acting as a cut-off type fixture.

Another object of the invention is to provide a reflector having increased illuminance on-grade which is most pronounced at points remote from the fixture resulting in a smoother, more uniform distribution of light than is produced by the standard refractor unit. Moreover, the all metal aluminum reflector is more resistant to vandalism than is the acrylic, plastic-lensed refractor unit.

Another important object of the invention is to provide a simplified fabricated reflector for utilization with the standard NEMA Head light fixture. By utilizing a hip spun at the top, the reflector may self center itself into the existing flange of the NEMA Head fixture and provide a secure, weather resistant seal between fixture and reflector.

BRIEF DESCRIPTION OF THE DRAWINGS

The construction designed to carry out the invention will be hereinafter described, together with other feature thereof.

The invention will be more readily understood from a reading of the following specification and by reference to the accompanying drawings forming a part thereof, wherein an example of the invention is shown and wherein:

FIG. 4 is a side elevational view illustrating the lighting fixture of FIG. 3 mounted upon a pole carried arm; and FIG. 5 is a perspective of a clamp for attending the reflector to a head.

DESCRIPTION OF THE PREFERRED EMBODIMENT

An outdoor pole mounted roadway lighting fixture is illustrated as having a head fixture housing bearing a first depending light source and having a disconnectable fastener thereon. A reflector spun from a single disc of aluminum has a side member A of generally parabolic configuration having a circular cross closing toward a top end and directing light from said light source downwardly at a lower open end forming a light impermeable reflecting portion of the reflector. An inwardly directed flange B is integral with the top end of the side member for receiving the light source therein and being complementary to a lower end C of the head to prevent the upward passage of light from the light source. A matt-like finish is provided on an interior surface of the reflector providing uniformity of spread and distribution of light. The lower open end of the side member has a substantially 90° cutoff preventing light from being directed upwardly. A disconnectable fastener D on the reflector adjacent the top end is engageable with the fastener on the head fixture housing.

The method contemplates spinning a reflector from a single disc of aluminum forming a side member of generally parabolic configuration directing light from said light source downwardly at a lower open end forming a light reflecting portion of said reflector providing a substantially 90° cutoff preventing upward direction of light, and forming an inwardly directed flange integral with a top end of said reflector sealing an upper end of said reflector against upward direction of light providing a matt finish on an interior surface of the reflector. Thereafter, mounting a disconnectable fastener on the reflector securable to said first mentioned disconnectable fastener and fastening the reflector to a pole carried head fixture housing.

Figure 1:
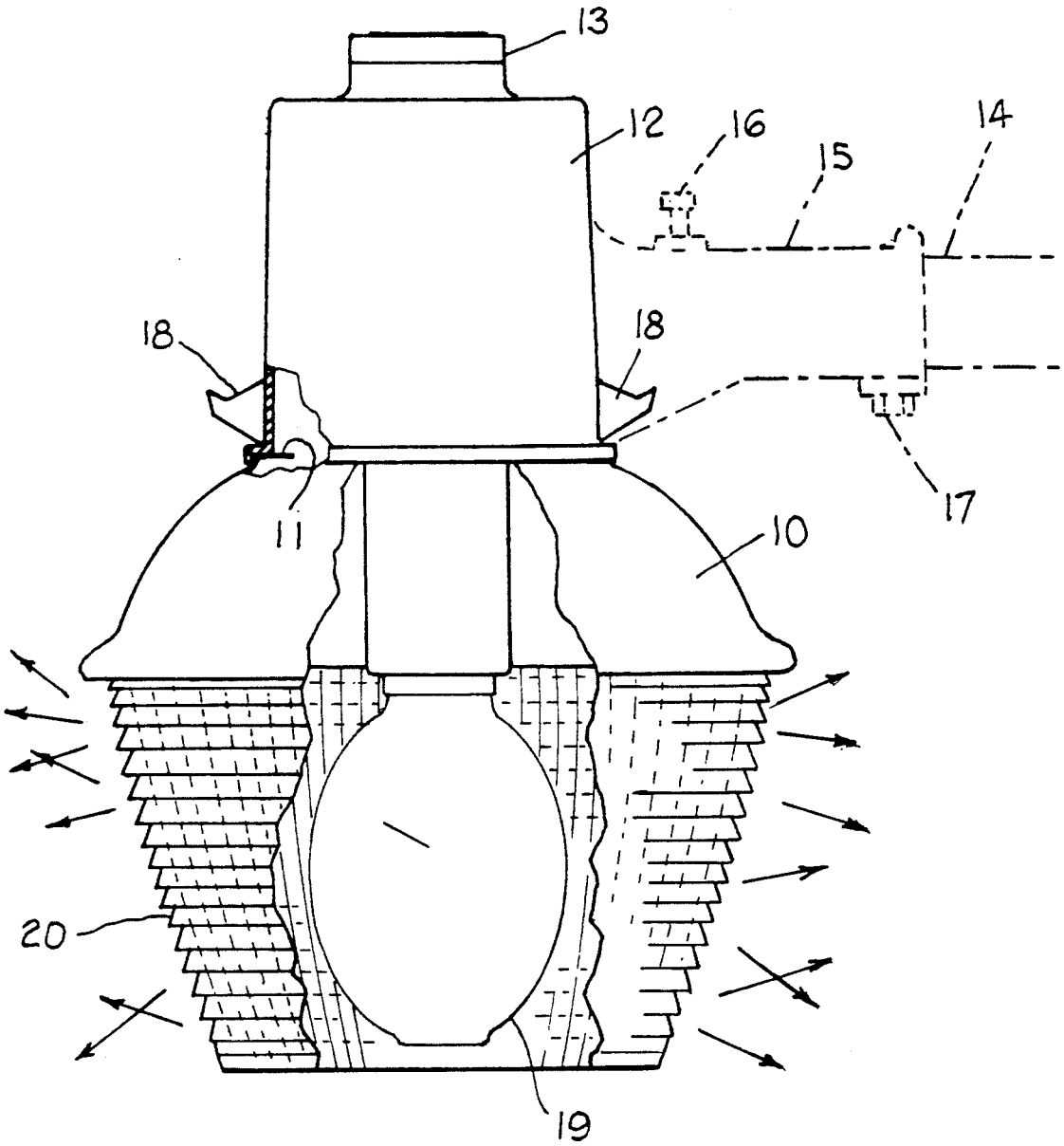
Fig. 1. PRIOR ART
FIG. 1 is a side elevational view illustrating a NEMA Head feature with a refractor constructed in accordance with the prior art.
Figure 2:
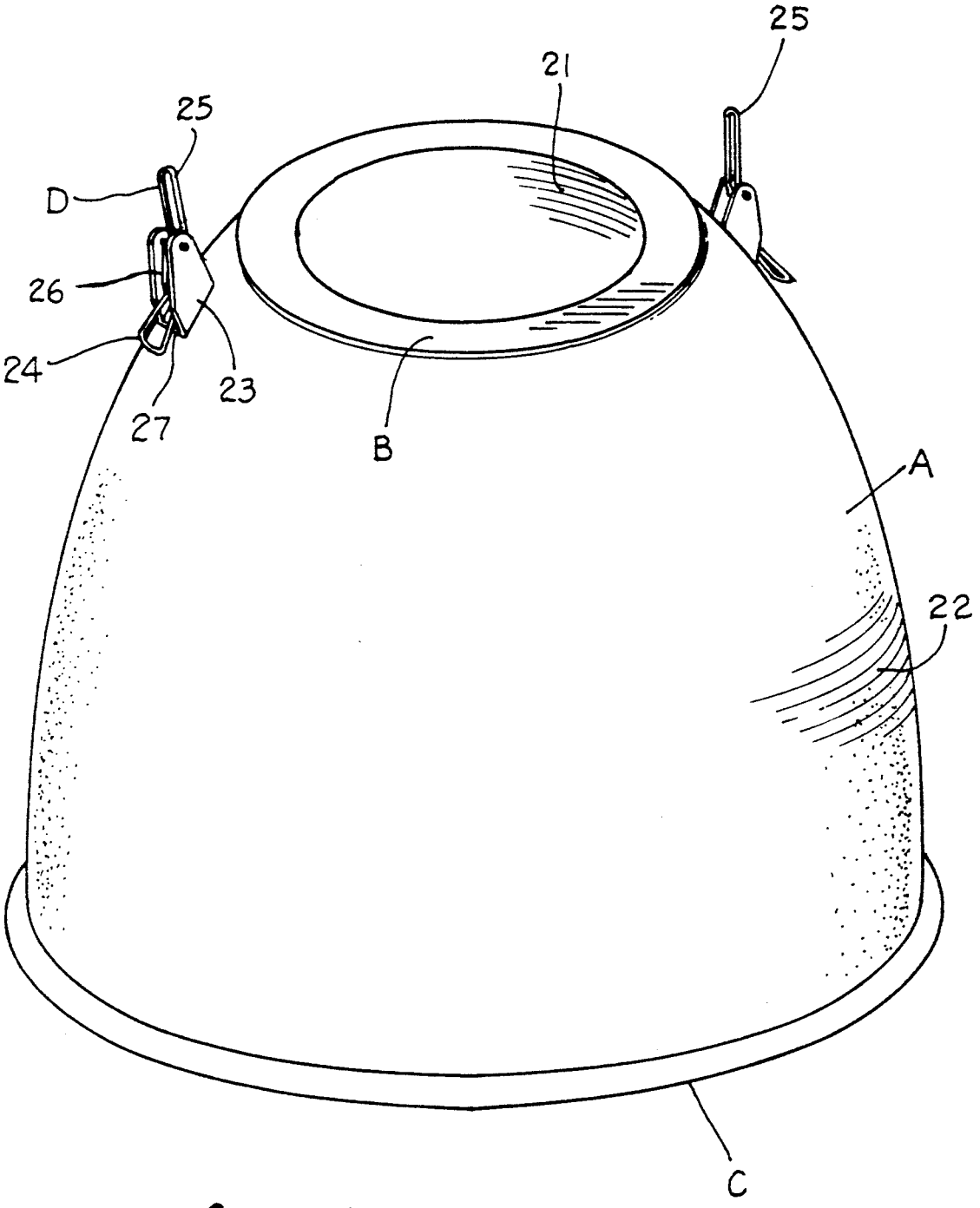
FIG. 2 is a perspective view from the top illustrating a reflector constructed in accordance with the invention.

The prior art is illustrated in FIG. 1 as including a two part refractor including an upper bowl-like portion 10 which is formed from spun aluminum. An upper end of the bowl-like member 11 receiving a standard NEMA Head fixture including a housing 12 which carries a photo control device 13. An arm illustrated in broken lines at 14 is received within the laterally extending hollow bracket 15 in which it is clampingly engaged by securement of the bolts 16 and 17. Opposed fixed clamping members 18 in the form of latching ears are carried adjacent a lower edge of the housing 12 for receiving spring biased clamps, not shown. A lamp is illustrated at 19 and is received within the refractor 20 which forms a lower half of the standard lighting fixture. The refractor includes prisms which are designed to direct light downwardly into the side, but such refractor allows considerable glare and considerable light to escape causing light contamination of the night sky. A reflector constructed in accordance with the invention is illustrated in FIG. 2, and it will be noted that a matt finish inside and out as illustrated at 21 and 22 such as results from the usual aluminum spinning process is illustrated. It is believed that more specular finishing may be utilized while avoiding a mirror finish.

Figure 3:
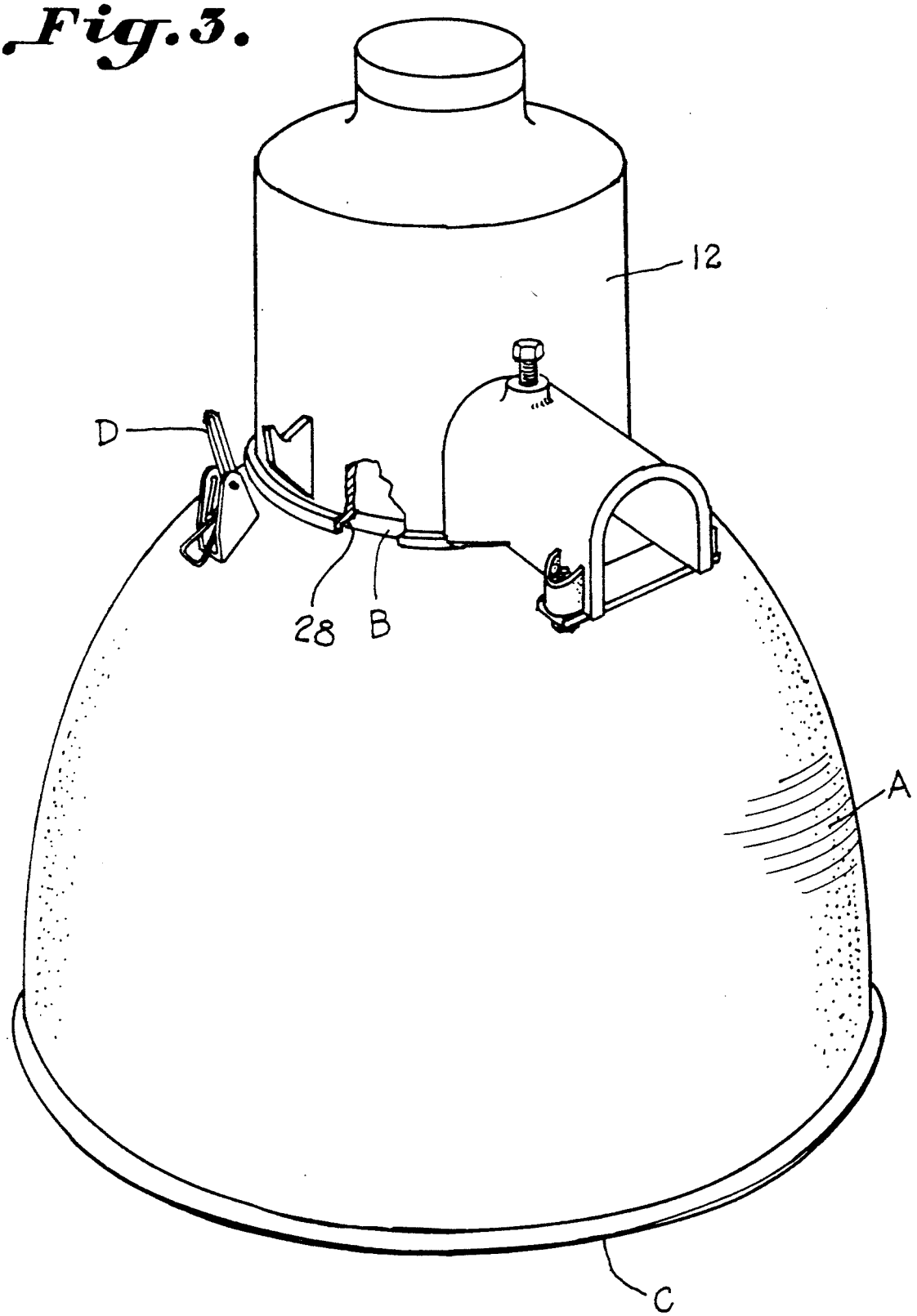
FIG. 3 is a perspective view illustrating a lighting fixture including a reflector constructed in accordance with the invention in combination with a head fixture housing bearing a depending light source.

During the spinning process, the reflector is formed from a single aluminum disc, and a circular HIP spinning process results in the formation of an inwardly extending flange B. The side members A are of parabolic configuration tapering inwardly in a pronounced fashion inwardly at top and opening downwardly at C at the bottom so as to provide a 90° cutoff. Such side configurations are determined by ray tracing and may be formed in the configuration of the Highbay Reflector catalogue No. BL-Bl by Hubbell Lighting, Inc. of 2000 Electric Way, Christiansburg, Va. 24073-0200. Opposed clamping members D include bracket members 23 which carry a pivoted latch member having a manually depressible member 24 opposite the loop catch member 25 which is spring biased by the member 26 (FIG. 5). The bracket 23 has a base portion 27 which is suitably secured to the outer portion of the side walls A. It will be observed by reference to FIG. 3 that the inwardly extending flange is complementary to and operates in sealing relation to a lower sealing member 28 carried by the housing 12.

As illustrated in FIG. 4 the fixture manufactured in accordance with the invention may be attached to a pole carrying arms 14 and the housing 12 attached to the reflector by means of the clamp D. As best shown in FIG. 4, the light projects downwardly and to the side having a 90° cutoff at the lower end A. The clamp is best shown in FIG. 5 and includes the base 27 and sides 23 for carrying the manually depressible end 24 of the loop 25.

EXAMPLE

The following example provide a comparison of the standard NEMA Head fixture standard refractor versus use with a reflector constructed in accordance with the invention.

An existing NEMA Head refractor unit with 150 W HPS lamp, pole mounted from a six foot arm was used in a street lighting application.

Light readings were taken at measured points in relation to the fixture refractor assembly. Light readings extended from directly under the assembly to points of minimum measurable value.

Again measuring light at the same locations as before, readings were recorded. At points on substantially the same grade the following readings were noted. At a point directly beneath the light fixture the conventional refractor produced respective reading of 1 foot candle versus 1.6 with the reflector of the invention. At points approximately 18 and 36 feet out the readings were 1.4 versus 1.4 and 0.1 versus 0.5 respectively.

The reflector produced no illumination above the fixture, and it outperformed the refractor in every category noted and measured. Moreover, it adds a degree to aesthetics to the light fixture's appearance, at rest in daylight or at work at night.

The reflector's cutoff characteristic effectively eliminated high angle glare in all directions. This is especially important to the vision of approaching motorists because instead of emitting high angle glare, the reflector constructed in accordance with the invention redirected the lamp's output down to the roadway and grade surfaces. By both visual observation and metered measurement, it did this far more smoothly than the original refractor.

Although the reflector does restrict the light above the horizontal, it does not drive all of the lamp's output directly down. Because of its broad, smooth distribution, producing good vertical illuminance on the shrubbery and doorways of an adjacent building, it is useful for security lighting use.

While a preferred embodiment of the invention has been described using specific terms, such description is for illustrative purposes only, and it is to be understood that changes and variations may be made without departing from the spirit or scope of the following claims.

What is claimed is:

1. For use in an outdoor pole mounted lighting fixture having a head fixture housing bearing a depending light source, the improvement comprising:

a unitary reflector formed from light impermeable material;

a side member of said reflector being of generally parabolic configuration having a circular cross section tapering inwardly toward a top end and directing light from said light source generally downwardly at a lower open end forming a light impermeable reflecting portion of said reflector;

an inwardly directed flange integral with and extending about said top end of said side member for receiving said light source therein and being complementary to a lower end of said head when joined to prevent the upward passage of light from said light source;

a matt-like finish on an interior surface of said reflector providing uniformity of spread and distribution of light;

said interior surface being of such a configuration as to reflect light generally downwardly toward said lower open end of said side member providing a substantially 90° cutoff at a horizontal plane avoiding directing light at an angle above the horizontal plane;

said lower end of said side member being entirely open to the atmosphere and devoid of any refractor so that said light is directed generally downwardly entirely by said interior surface of said reflector; and a disconnectable fastener on said reflector adjacent said top end and being engageable with said head fixture housing;

whereby loss of light and sky contamination through upwardly directed light is avoided.

2. The structure set forth in claim 1 wherein said disconnectable fastener is a clamping member engageable with a complementary member on said head fixture housing.

3. The method of providing a uniform spread and distribution of light from an outdoor pole mounted source avoiding loss through upward reflection comprising the steps of:

spinning a reflector from a single disc of aluminum forming a side member of generally parabolic configuration directing light from said light source generally downwardly at a lower open end forming a light reflecting portion of said reflector providing a substantially 90° cutoff at a horizontal plane avoiding directing light at an angle above the horizontal plane;

forming an inwardly directed flange integral with a top end of said reflector sealing an upper end of said reflector against upward direction of light providing a matt finish on an interior surface of said reflector;

leaving said lower nd of said reflector entirely open to the atmosphere and devoid of any reflector and then directing light generally downwardly entirely by said interior surface of said reflector;

securing a mounting head bearing a depending light source and having a disconnectable fastener thereon to an arm carried by said pole;

mounting a disconnectable fastener on said reflector securable to said first mentioned disconnectable fastener; and securing said reflector on said mounting head affixing said disconnectable fastener.

4. For use in an outdoor pole mounted lighting fixture having a head fixture housing bearing a depending light source, the improvement comprising:

an integral unitary reflector spun from aluminum;

a side member of said reflector forming a light impermeable member of generally parabolic configuration having a circular cross section tapering inwardly toward an open top end containing said light source and directing light from said light source downwardly at a lower open end;

a connection integral with and extending adjacent said open top end of said side member for receiving said light source therein and being complementary to a lower end of said head to prevent the upward passage of light from said light source;

a matt-like finish on an interior surface of said reflector providing uniformity of spread and distribution of light;

said interior surface being of such a configuration as to reflect light generally downwardly with a substantially 90° cutoff at said lower open end of said side member avoiding directing light at an angle above the horizontal;

said bottom of said reflector being entirely open to the atmosphere and devoid of any refractor so that said light is directed generally downwardly entirely by said interior surface of said reflector; and a fastener on said reflector adjacent said top end engageable with said head fixture housing for securing said reflector to said head fixture;

whereby loss of light and sky contamination through upwardly directed light is avoided.

5. The structure set forth in claim 4 including means adjacent said top end of said reflector for self-centering in respect to said head fixture and depending light source.

6. The structure set forth in claim 4 wherein said connection includes a hip at said top end for self-centering and wherein said fastener is a disconnectable clamping member engageable with a complementary member on said head fixture housing.

7. The structure set forth in claim 6 wherein said connection further includes an inwardly directed flange.

* * * * *